US008117972B2

(12) United States Patent
Winget et al.

(10) Patent No.: US 8,117,972 B2
(45) Date of Patent: Feb. 21, 2012

(54) KIT AND SHELVING SYSTEM TO STORE WORK TOOLS, EQUIPMENT AND SUPPLIES IN A MOTOR VEHICLE AND PLASTIC SHELF FOR USE THEREIN

(75) Inventors: Larry J. Winget, Leonard, MI (US); Nicholas R. Demiro, Rochester, MI (US); Darius J. Preisler, Macomb, MI (US); Bryan A. Frohriep, Roseville, MI (US)

(73) Assignee: Global IP Holdings, LLC, Sterling Heights, MI (US)

( * ) Notice: Subject to any disclaimer, the term of this patent is extended or adjusted under 35 U.S.C. 154(b) by 285 days.

(21) Appl. No.: 12/169,798

(22) Filed: Jul. 9, 2008

(65) Prior Publication Data

US 2010/0006520 A1 Jan. 14, 2010

(51) Int. Cl.
*A47B 9/00* (2006.01)

(52) U.S. Cl. ..... 108/108; 108/27

(58) Field of Classification Search ..... 108/27, 108/108; 428/73, 116, 118; 52/783.17, 796.11, 52/796.12; 248/345.1; 296/24.3, 24.4, 24.44
See application file for complete search history.

(56) References Cited

U.S. PATENT DOCUMENTS 2,833,003 A * 5/1958 Bourne et al. ..... 428/73
3,476,422 A * 11/1969 Campbell ..... 52/793.1
3,611,548 A * 10/1971 Parris ..... 108/92
4,191,436 A 3/1980 Cherry
4,699,836 A * 10/1987 Fearon et al. ..... 428/73
4,931,340 A * 6/1990 Baba et al. ..... 428/73
4,937,125 A * 6/1990 Sanmartin et al. ..... 428/116
5,139,596 A 8/1992 Fell
5,397,201 A * 3/1995 Novak et al. ..... 52/309.15
5,498,048 A 3/1996 Shelby, Jr.
5,686,782 A 11/1997 Hecker, Jr. et al.
5,722,244 A * 3/1998 Shelton ..... 62/74
5,853,843 A * 12/1998 Patel et al. ..... 428/116
5,888,610 A * 3/1999 Fournier et al. ..... 428/116
6,050,630 A 4/2000 Hochet
6,189,945 B1 2/2001 Rockett
6,386,412 B1 * 5/2002 Konechne ..... 224/543
6,435,577 B1 8/2002 Renault
6,537,413 B1 3/2003 Hochet et al.
6,655,299 B2 12/2003 Preisler et al.
6,682,675 B1 1/2004 Vandangeot et al.
6,682,676 B1 1/2004 Renault et al.
6,710,133 B2 3/2004 Gebreselassie et al.
6,748,876 B2 6/2004 Preisler et al.
6,790,026 B2 9/2004 Vandangeot et al.
6,823,803 B2 11/2004 Preisler
6,843,525 B2 1/2005 Preisler
6,890,023 B2 5/2005 Preisler et al.
6,928,786 B2 * 8/2005 Orozco ..... 52/800.12
6,981,863 B2 1/2006 Renault et al.
7,401,442 B2 * 7/2008 Clark et al. ..... 52/783.1

(Continued)

*Primary Examiner* — Hanh V Tran
(74) *Attorney, Agent, or Firm* — Brooks Kushman P.C.

(57) ABSTRACT

A kit and shelving system to store work tools, equipment and supplies in a motor vehicle and plastic shelves for use therein are provided. Each of the shelves includes a reinforced composite panel of the cellular core sandwich-type. Each of the panels has front, back and side edge portions. Each of the shelves includes a first shelf support having an outer facing surface and an inner channel dimensioned to receive and retain a first one of the edge portions of the panel. The first edge portion of the panel is bonded to the first shelf support within the inner channel.

15 Claims, 5 Drawing Sheets

U.S. PATENT DOCUMENTS

| | | | | |
|---|---|---|---|---|
| 7,641,253 | B2 * | 1/2010 | Steiger et al. | 296/24.4 |
| 2002/0043747 | A1 | 4/2002 | Vismara | |
| 2004/0241383 | A1 | 12/2004 | Watanabe et al. | |
| 2005/0189674 | A1 | 9/2005 | Hochet et al. | |
| 2007/0069542 | A1 | 3/2007 | Steiger et al. | |

* cited by examiner

KIT AND SHELVING SYSTEM TO STORE WORK TOOLS, EQUIPMENT AND SUPPLIES IN A MOTOR VEHICLE AND PLASTIC SHELF FOR USE THEREIN

CROSS-REFERENCE TO RELATED APPLICATIONS

This application is related to U.S. patent application entitled "Method And System For Making Cellular Parts And Thermoplastic Composite Articles Utilizing Same" filed Apr. 17, 2008 and having U.S. Ser. No. 12/104,698.

BACKGROUND OF THE INVENTION

1. Field of the Invention

This invention relates to kits and shelving systems to store work tools, equipment and supplies in a motor vehicle and plastic shelves for use therein.

2. Background Art

Many workers use specialized tools and equipment in performing their daily tasks. Because many job sites are away from the job shop, any tools and equipment needed must be transported to the job site. A worker typically requires a vehicle large enough to accommodate the tools, equipment and supplies required at the job site. As illustrated in FIG. 1, a problem associated with such vehicles is that there is typically not a huge amount of space in such vehicles. Electricians, telephone repairers, cable installers, and plumbers must carry an assortment of tools, fasteners, pipes and other supplies to be adequately prepared to complete a job or service call. Accordingly, it will be appreciated that it would be highly desirable to have a vehicle with storage areas for tools, supplies and equipment so that a worker can efficiently transport the required items to the job site.

U.S. Pat. Nos. 4,191,436; 6,189,945 and 5,498,048 disclose various apparatus, adjustable shelves and cabinets for use in motor vehicles.

Many of the storage units known in the art are steel units that include steel end panels, a back panel and steel shelving, as shown in FIG. 2. FIG. 3 shows a welded wire shelving system. The shelves of these storage units are essentially tray structures having a bottom and four sides extending perpendicular from and perpendicular to the bottom. The shelves are fitted between the two end panels adjacent the back panel to provide a storage unit. The shelves are held in position by connecting the shelves directly to each of the end panels and the back panel. The shelves may be held in position by welding the sides of the shelves to the end panels and the back panel or by mechanical fasteners connecting the shelves to each of the end and back panels through the sides of the shelves.

There are several disadvantages associated with these known storage units. Storage units known in the art are essentially as-is structures that are not easily reconfigurable or adjustable. It may be advantageous or even necessary for a worker to house an item in the vehicle for which no space currently exists. Therefore, it would be beneficial for the worker to be able to reconfigure the storage system in his vehicle by moving, adding or removing shelving, drawers, etc. Shelves that are welded to the end and back panels are not removable (or, at least, no easily removed). In the storage unit described above, shelves or drawers are connected to both back panels and the end panels and therefore cannot be adjusted or reconfigured without either completely removing the unit from the vehicle or unmounting the end panels and back panel.

Additionally, several disadvantages are associated with the all steel construction of the storage units. First, the all steel construction may create a noisy environment. When empty, the steel units are prone to rattling during the operation of the vehicle. The noise level may be increased when the units are filled with various equipment including metal tools or parts. Second, the all steel units can be rather heavy, and the added weight to a vehicle may increase fuel consumption for operation of the vehicle and increase the cost to operate the vehicle.

Published U.S. patent application 2007/0069542 seeks to solve many of the above noted problems by providing an adjustable storage system including one or more adjustable storage units. The storage units generally comprise opposing panels comprising a polymer material and one or more shelf support means that are integral with the panels. Shelves and/or drawers, also made from polymer materials, may then be disposed between the panels. The shelves appear to be blow molded. Storage units may be added to the storage system by adding additional panels. In some embodiments, adjacent storage units of a storage unit may share a panel. The storage system is generally illustrated in FIGS. 4-6.

Some problems associated with the storage system of FIGS. 4-6 is that the load rating of a polymer shelf may not be able to withstand a particular load. In this case, additional supports are provided in enclosed areas on the undersurface of the shelf, as indicated in FIG. 5. However, this adds additional cost and weight to the system as well as taking away valuable storage space from the system due to the increased thickness of each shelf.

Due to increasing federal environmental regulations and decreasing availability of landfill space, there is increased interest in recycling post-consumer products such as vehicle interior trim panels. Unfortunately, many conventional vehicle interior articles are formed from non-recyclable materials such as thermosetting resins, which cannot be remelted and reused.

Thus, there is a need for recyclable vehicle interior articles that have durable, tough surfaces, that are impervious to water and most chemicals, and that are designed to be scratch and mar resistant. In addition, there is a need for recyclable vehicle interior articles that can reduce external noises (e.g., road noise, engine noise, vibrations, etc.), as well as noises emanating from within passenger compartments, while also being lightweight and low in cost. U.S. Pat. No. 6,710,133 discloses a vehicle interior article including a layer of recyclable polymeric material.

One type of recyclable, lightweight, high-strength, composite material or article comprises a "honeycombed" cellular core positioned between two thermoplastic skins reinforced with glass and polypropylene. Polypropylene is highly regarded for its heat and chemical resistance as well as for its ability to withstand wear and tear. The thermoplastic skins, tough and meltable for reuse, have a degree of elasticity between 5 and 20 GPa, depending on fiber content and orientation. The composite article typically ranges in thickness between 5 and 30 mm. Its weight ranges from 1700 to 6000 $g/m^2$, depending on skin and core materials.

In contrast to more conventional thermoset resin composites, thermoplastics used in the composite article provide greater robustness due to their tougher matrix. They also offer enhanced formability and functional integration, consist of less expensive raw materials and can be processed faster. Also, living hinges (i.e., U.S. published application 2005/0189674) and deep draw shapes (i.e., U.S. Pat. Nos. 6,682,675; 6,682,676; 6,790,026; and 6,981,863) can be made with the composite article while maintaining structural integrity.

Via thermocompression, production is a one-step process that takes approximately one minute (i.e., U.S. Pat. Nos. 6,050,630 and 6,537,413). Simultaneous exposure to heat and pressure changes the "sandwich" to a thermoplastic composite, yielding high-strength-to-weight and high-stiffness-to-weight properties as well as a finished product that is highly resistant to heat, impact and corrosion.

Applications for such thermoplastic composite materials or articles include pallets (i.e., U.S. Pat. Nos. 6,655,299; 6,748,876; and 6,823,803), vehicle load floors (i.e., U.S. Pat. No. 6,843,525), under-engine fairings (U.S. Pat. No. 6,435,577), inner roof panels (U.S. Pat. No. 6,890,023), trunk panels, backrests, aerodynamic skid plates, spare wheel pans, and front and rear vehicle bumpers.

One way to make the interior plastic cellular core or honeycomb part is to make the core from a plurality of small co-extruded tubes bonded to each other along their sides (i.e., U.S. Pat. No. 5,683,782). The small tubes have a base body made of a thermoplastic and which, at least on the outside, preferably on the outside and on the inside, carries a coating made of an adhesively-active thermoplastic material. As a result of this coating, a bonding of the small honeycomb tubes to each other as well as to a cover layer is possible.

Another way to make a plastic cellular or honeycomb part is to make the fiber-reinforced thermoplastic honeycomb in a continuous manner one half cell at a time by laying down a corrugated web of thermoplastic, with and without fiber-reinforcement atop a honeycomb, selectively fusing the node-antinode demes and repeating the process until a honeycomb of the desired depth is prepared (i.e., U.S. Pat. No. 5,139,596).

Yet still another way to make a plastic cellular or honeycomb part is to injection mold the honeycomb part in plastic (U.S. published application Nos. 2002/0043747 and 2004/0241383).

SUMMARY OF THE INVENTION

An object of at least one embodiment of the present invention is to provide a kit and shelving system to store work tools, equipment and supplies in a motor vehicle and plastic shelf for use therein, wherein the plastic shelves are quiet, strong, easy to install and/or remove, lightweight and recyclable.

In carrying out the above object and other objects of at least one embodiment of the present invention, a kit from which a plurality of parts are selected and arranged to provide storage areas for at least one of work tools, equipment and supplies in a motor vehicle is provided. The kit includes a plurality of plastic shelves. Each of the shelves includes a reinforced composite panel of the cellular core sandwich-type. Each of the panels has front, back and side edge portions. A first shelf support has an outer facing surface and an inner channel dimensioned to receive and retain a first one of the edge portions of the panel. The first edge portion of the panel is bonded to the first shelf support within the inner channel.

The inner channel may be U-shaped in cross section.

Each of the shelves may further include a second shelf support having an outer facing surface and an inner channel dimensioned to receive and retain a second one of the edge portions of the panel. The second edge portion may be bonded to the second shelf support within the inner channel of the second shelf support.

The kit may further include a pair of side shelf support mechanisms for supporting the shelves in a desired spaced relationship at the side edge portions of the panels.

The motor vehicle may be a cargo van.

Each of the plastic shelves may be made of a recyclable thermoplastics material.

Each of the shelves may be capable of supporting 250 pounds of weight with not more than 8 mm of deflection.

Each of the shelves may be constructed mainly of polyolefin and, preferably, polypropylene.

Each of the panels may have a substantially uniform thickness.

The thickness may be between 5 mm and 30 mm.

Each of the panels may include a load-bearing upper skin made of reinforced thermoplastics material, a cellular core of a thermoplastics material and a bottom skin made of reinforced thermoplastics material.

The cellular core may have a honeycomb-like structure.

The kit may further include an outer covering layer disposed on the upper skin.

Each of the panels may be substantially flat and may be obtained from a single pressing stage.

The single pressing stage may have a forming pressure for forming each of the panels which lies in the range of 106 Pa to $3\times10^6$ Pa.

While each of the panels is being formed, the skins may have a forming temperature lying in the range of approximately 120° C. to 200° C.

The skins may be made of a woven fabric or a mat of glass fibers and of a thermoplastic material.

The thermoplastics material of the skin may be polyolefin and, preferably, polypropylene.

The cellular core may have an open cell structure of the tubular or honeycomb cell type, constituted mainly of polyolefin and preferably polypropylene.

The open cells may have a diameter in the range of 2 mm to 10 mm.

Further in carrying out the above object and other objects of at least one embodiment of the present invention, a plastic shelf including a reinforced composite panel of the cellular core sandwich-type is provided. The panel has front, back and side edge portions. A first shelf support has an outer facing surface and an inner channel dimensioned to receive and retain a first one of the edge portions of the panel. The first edge portion of the panel is bonded to the first shelf support within the inner channel.

The inner channel may be U-shaped in cross section.

The shelf may further include a second shelf support having an outer facing surface and an inner channel dimensioned to receive and retain a second one of the edge portions of the panel. The second edge portion may be bonded to the second shelf support within the inner channel of the second shelf support.

Still further in carrying out the above object and other objects of at least one embodiment of the present invention, a shelving system for providing storage areas for at least one of work tools, equipment and supplies in a motor vehicle is provided. The system includes a plurality of plastic shelves. Each of the shelves includes a reinforced composite panel of the cellular core sandwich-type. Each of the panels has front, back and side edge portions and a first shelf support having an outer facing surface and an inner channel dimensioned to receive and retain a first one of the edge portions of the panel. The first edge portion of the panel is bonded to the first shelf support within the inner channel and a pair of side shelf support mechanisms for supporting the shelves in a desired spaced relationship at the side edge portions of the panels.

The inner channel may be U-shaped in cross section.

Each of the shelves may further include a second shelf support having an outer facing surface and an inner channel dimensioned to receive and retain a second one of the edge portions of the panel. The second edge portion may be bonded to the second shelf support within the inner channel of the second shelf support.

The above object and other objects, features, and advantages of at least one embodiment of the present invention are readily apparent from the following detailed description of the best mode for carrying out the invention when taken in connection with the accompanying drawings.

DETAILED DESCRIPTION OF THE PREFERRED EMBODIMENT(S)

In general, at least one embodiment of the present invention relates to a kit and shelving system to store work tools, equipment and supplies in a motor vehicle. Each kit and system includes a plurality of plastic shelves. The hybrid kit and system are specifically designed for use in utility vans/vehicles. Metal shelves of the prior art are replaced with high performance, low cost, lightweight, all-plastic shelves which are not only user friendly but also less noisy. The shelves are also easy to install and/or remove. The shelves offer the end user a quiet, strong and recyclable alternative to metal shelves at an affordable price. The shelves include a reinforced composite panel of the cellular core sandwich-type to achieve a strong, lightweight and user friendly shelving system and kit that is "green" to the marketplace. The shelves have a strength-to-weight ratio typically greater than steel and are quieter than steel (as well as hollow plastic parts such as blow molded plastic parts), easily adjustable in the field and are fully recyclable.

A kit from which a plurality of parts are selected and arranged to provide storage areas for at least one of work tools, equipment and supplies in a motor vehicle is provided, as shown in FIGS. 7-10. The kit includes a plurality of plastic shelves, generally indicated at 20. Each of the shelves includes a reinforced composite panel, generally indicated at 110, of the cellular core sandwich-type. Each of the panels 110 has front, back and side edge portions.

Figure 10:
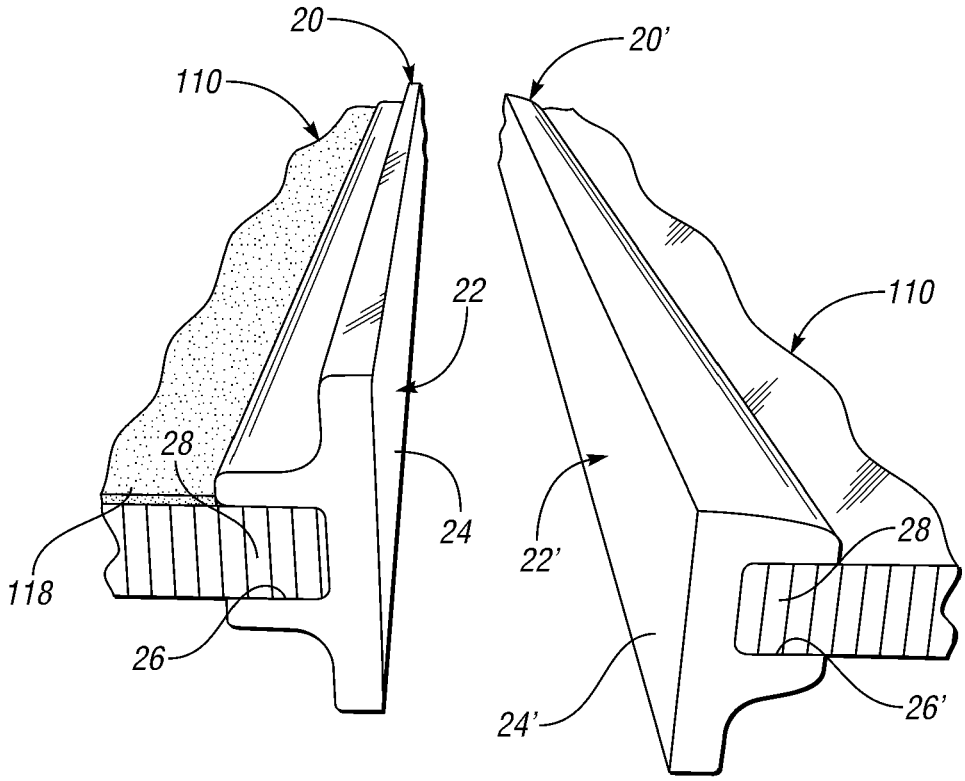
FIG. 10 is a perspective view, partially broken away, of a pair of plastic shelves each of which is constructed in accordance with an embodiment of the present invention.

A front shelf support (a first embodiment of which is shown in FIG. 10 at 22 and a second embodiment of which is shown in FIG. 10 at 22') has an outer facing surface 24 and 24', respectively, and an inner channel 26 and 26', respectively. The inner channel 26 and 26' is dimensioned to receive and retain a front edge portion 28 of the panel 110. The front shelf support 22 and 22' is typically made of a glass-filled (for example 20%) polypropylene. The front edge portion 28 of the panel 110 is bonded to the front shelf support 22 and 22' within the inner channel 26 and 26', respectively, such as by vibration welding.

The inner channel 26 and 26' is preferably U-shaped in cross section, as shown in FIG. 10.

Figure 8:
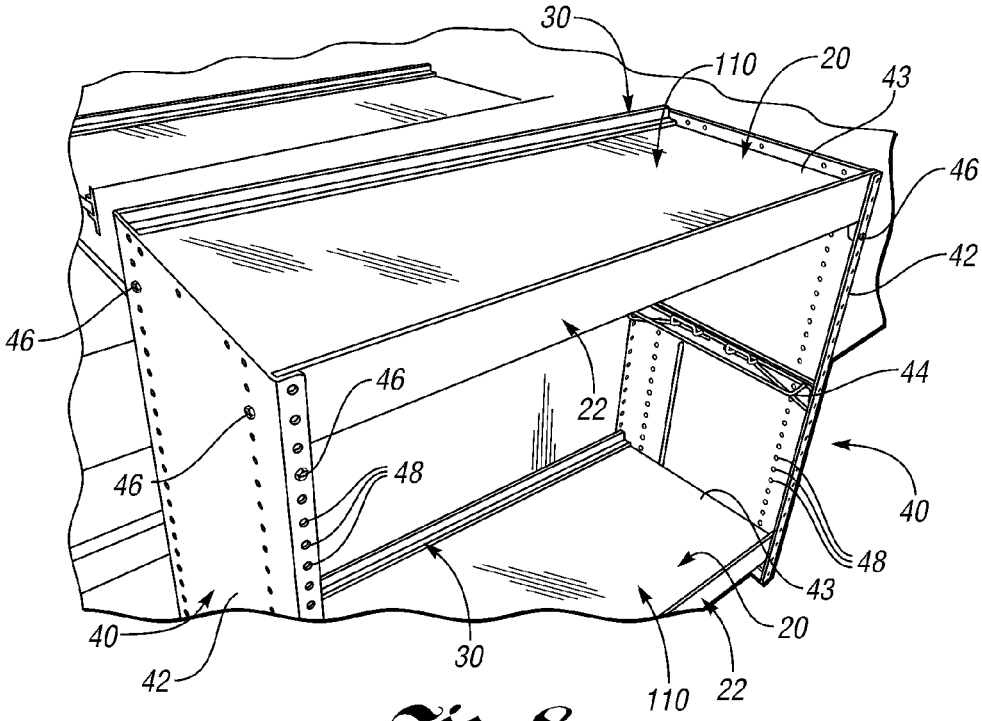
FIG. 8 is a perspective view of one plastic shelf of the embodiment of FIG. 7 in a partially assembled shelving system.
Figure 9:
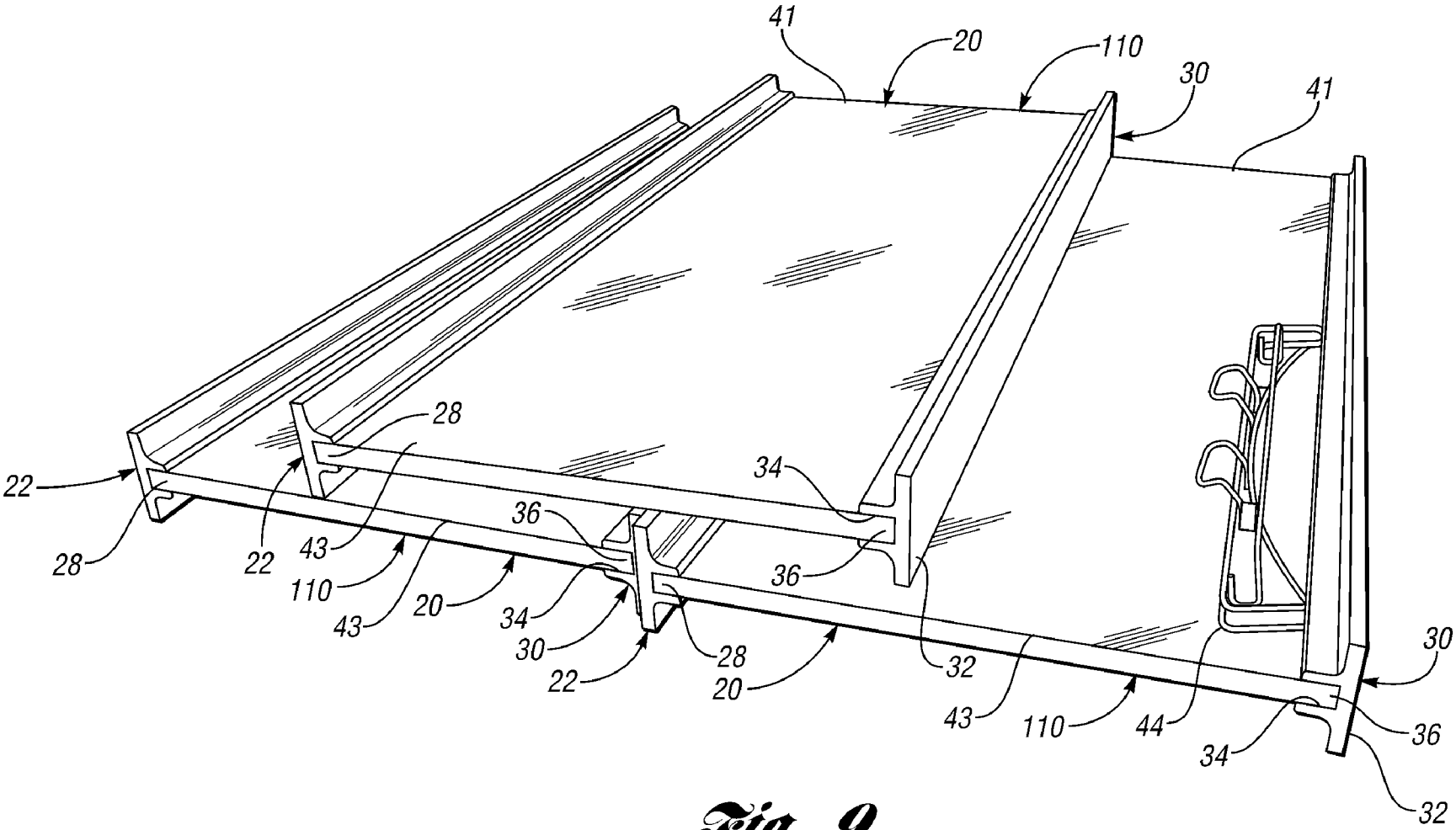
FIG. 9 is a perspective view of a plurality of shelves and a shelf support of the kit.

Each of the shelves 20 further includes a back shelf support, generally indicated at 30 in FIGS. 8 and 9, having an outer facing surface 32 and an inner channel 34 dimensioned to receive and retain a back edge portion 36 of the panel 110, as best shown in FIG. 9. The back edge portion 36 is bonded to the back shelf support 30 within the inner channel 34 of the back shelf support 30, such as by vibration welding.

Figure 1:
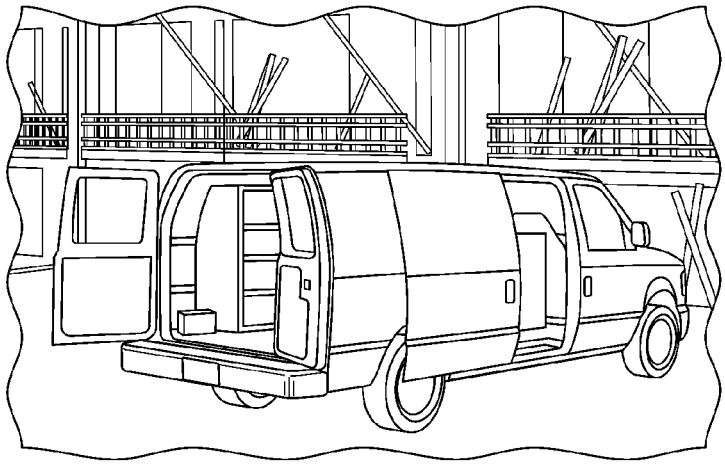
Fig. 1 (PRIOR ART)
FIG. 1 is a perspective view of a prior art cargo van at a work site with many of its doors open.
Figure 2:
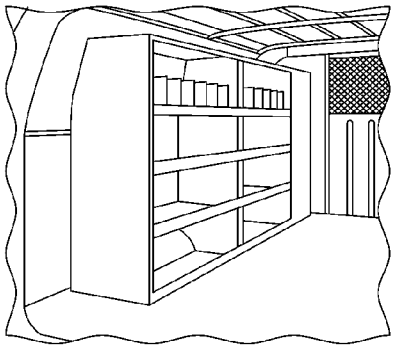
Fig. 2 (PRIOR ART)
FIG. 2 is a perspective view, partially broken away, of the interior of a prior art cargo van.
Figure 3:
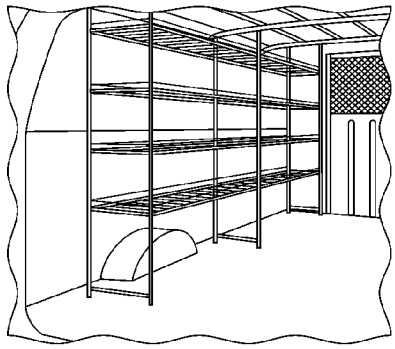
Fig. 3 (PRIOR ART)
FIG. 3 is a perspective view, partially broken away, of the exterior of another prior art cargo van.
Figure 4:
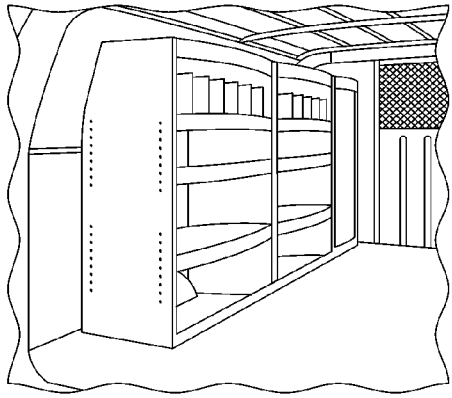
Fig. 4 (PRIOR ART)
FIG. 4 is a perspective view, partially broken away, of the interior of yet another prior art cargo van.
Figure 5:
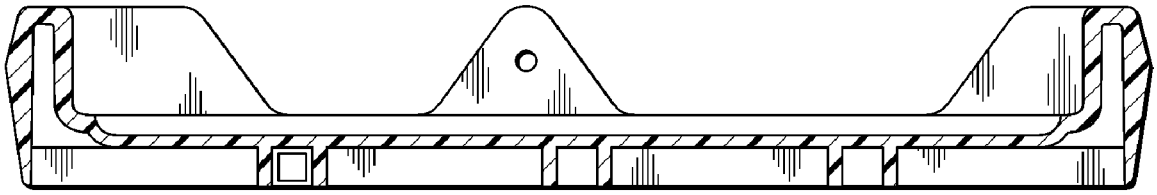
Fig. 5 (PRIOR ART)
FIG. 5 is a front sectional view of a shelf within the cargo van of FIG. 4.
Figure 6:
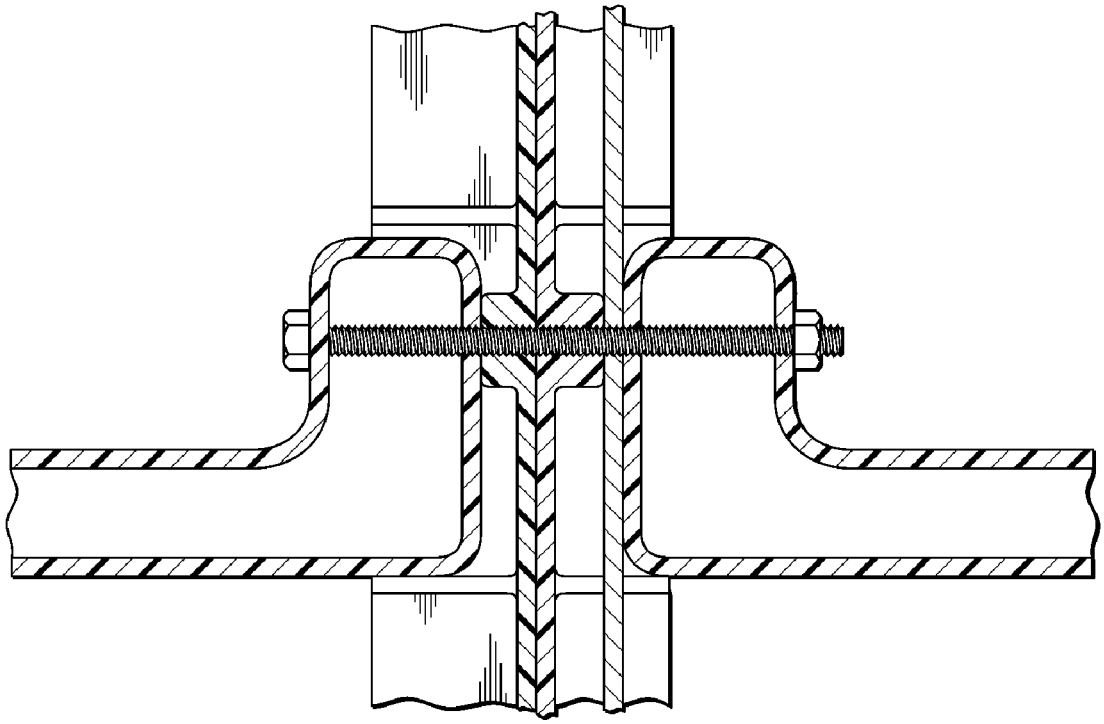
Fig. 6 (PRIOR ART)
FIG. 6 is an enlarged front view, partially broken away and in cross-section, of a pair of interconnected shelves within the cargo van of FIG. 4.
Figure 7:
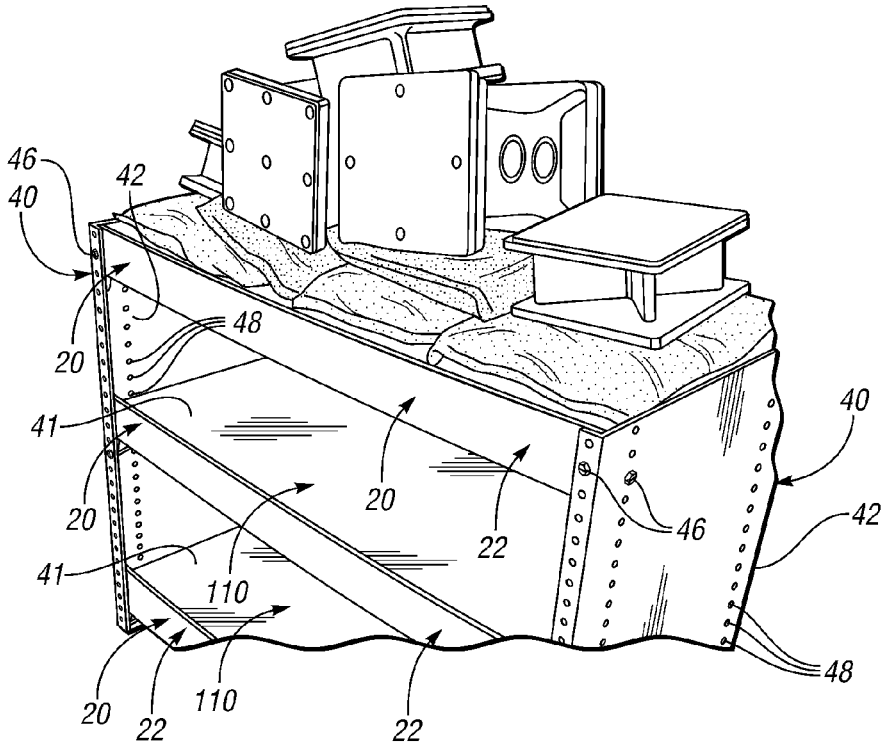
FIG. 7 is a perspective view of a loaded shelving system made from a kit including plastic shelving made in accordance with an embodiment of the present invention.

The kit further includes a pair of side shelf support mechanisms, generally indicated at 40, for supporting the shelves 20 in a desired spaced relationship at the side edge portions 41 and 43 of the panels 110. Each side shelf support mechanism 40 typically includes a flanged metal panel 42, a plurality of wire metal hangers 44 for mounting the shelves 20 onto the metal panels 42 at their side edge portions 41 and 43 and a plurality of bolts 46 which extend through holes 48 formed through the metal panels 42 and through holes in the hangers 44. Each hanger 44 receives and retains a side edge portion (41 or 43) of a panel 110 therein. The end user selects a desired height of the shelves 20 and places the bolts 46 through corresponding holes 48 in the metal panels 42 and holes in the hangers 44. Nuts (not shown) secure the bolts 46 to the panels 42 and the hangers 44. For additional support, some of the bolts 46 may extend into the front and back shelf supports 22 and 30, as shown in FIG. 7.

Each of the supported shelves 20 is capable of supporting 250 pounds of weight with not more than 8 mm of deflection.

Figure 11:
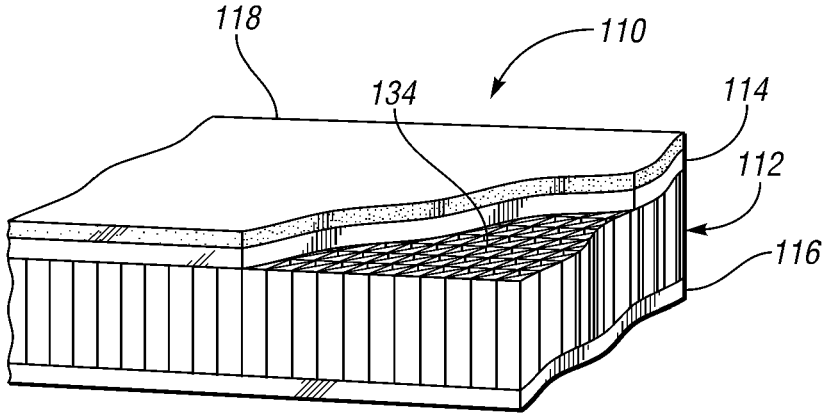
FIG. 11 is a perspective schematic view, partially broken away, of a thermoplastic composite panel with a plastic cellular part or core having open cells for use as a plastic shelf constructed in accordance with an embodiment of the present invention.

There is illustrated in FIG. 11 a portion of a reinforced composite panel or article, generally indicated at 110, of the sandwich-type having a cellular core or part, generally indicated at 112. The article 110 also includes one or more upper skin layers and one or more lower skin layers 114 and 116, respectively, made of a reinforced thermoplastics material. In addition, the article 110 may include one or more outer covering layers 118 made of a woven or non-woven material disposed on the upper skin layer 114 (and on the lower skin layer 116 if more than one outer covering layer is included). The outer covering layer(s) 118 maybe made of felt or carpeting, such as polypropylene carpeting.

Materials Used for the Skin Layers 114 and 116

The skin materials are preferably made of a polyolefin such as polypropylene reinforced with fibers. However, other materials can also be used.

The properties of the skin layers 114 and 116 depend on:

- Glass content (typically 20 wt % to 60 wt %);
- Glass orientation, woven 50/50 or 80/20 as needed for loads;
- Structure of the reinforcement (continuous woven fibers, continuous UD fibers, random glass mats, chopped glass fibers, etc.) and the core 112; and
- Thickness, which depends on load and application but generally not to exceed 30 mm and at least 5 mm.

Each skin layer 114 or 116 is characterized by its weight per surface area within a range of typically 400 to 1500 g/m$^2$.

Some examples of the materials used for the skin layers 114 and 116 are:

Woven co-mingled fibers. Glass fibers and polypropylene fibers are co-mingled to form a hybrid roving. The process yields a product in which the glass fibers and thermoplastic fibers are uniformly dispersed. This co-mingling technique allows for a high glass fiber content (60 to 75 wt %) because it ensures a good fiber wetting by the matrix. Adequate wetting of the glass fibers ensures high mechanical performance of the composite article 110. Hybrid rovings are then woven with several possible orientations. When the roving is heated above the melting point of the thermoplastic fibers, the thermoplastic flows around the glass fibers. The uniform co-mingling of the glass and thermoplastic fibers limits the distance the thermoplastic is required to flow and allows the material to be molded with very low pressures (about 10 bars to a maximum of about 30 bars). A commercial material is Twintex manufactured by Vetrotex Saint Gobain. Twintex is typically preconsolidated before being used in the process.

Mat of fibers with PP. It is a thin, continuous roll stock made of partially-consolidated polypropylene reinforced with fiber glass mat. Many thicknesses are available from a glass basis weight of 80 g/m$^2$ up to 1000 g/m$^2$. Glass content can vary from 20% by weight to 50% or more. The glass fibers are in a random configuration. It is also possible to use other types of fibers such as natural fibers, carbon fibers, and aramid fibers.

The cellular core 112 has an open-celled structure of the honeycomb cell type, constituted mainly of polyolefin and, preferably, polypropylene. Referring to the above-noted application, there is disclosed one method of making the plastic cellular part or core 112 by injection molding. However, it is to be understood that there are other ways to make the core 112 as illustrated by the prior art.

The method of the above-noted application includes providing a mold having a mold cavity with an interior surface to define the shape of the cellular part 112 and at least one resin flow path extending from an outer surface of the mold to the mold cavity. A first set of projections or pins extend from the interior surface of the upper mold half into the mold cavity from a first direction and touch or almost touch the interior surface the lower mold half. A second set of projections or pins extend into the mold cavity from a second direction opposite the first direction. The projections define cells 134 of the part 112 which open to opposing outer surfaces of the cellular part 112.

The mold cavity is filled by an injection molding machine with the sets of projections and extending into the mold cavity, with molten plastic resin from the machine flowing along at least one resin flow path to the mold cavity. A manifold such as a hot runner manifold may be used to provide a number of drops into the mold cavity. The resulting cellular part or core 112 is removed from the mold cavity of the mold after the cellular part 112 hardens.

The cells 134 may have a triangular configuration or the cells 134 may form a honeycomb including cylindrical, hexagonal, or square cells. Other shapes are also possible. The axes of the cells 134 are perpendicular to the outer surfaces of the core 112 as well as the skin layers 114 and 116 of the article 110. Cell density is adjusted as needed for load. The open cells 134 typically have a diameter in a range of 2 mm to 10 mm.

In the method of making an article 110, a stack of skin layers 114 and 116 and the core 112 (and the layer(s) 118 if desired) are preferably pre-assembled. Then, the pre-assembled stack is heated in an oven (not shown). The pre-assembled stack is heated such that the skin layers 114 and 116 of the stack have a forming temperature approximately in the range of 120° C. to 200° C. The temperatures to which the pre-assembled stack is heated are higher than the degradation temperature of the polypropylene constituting the matrices of the skin layers 114 and 116, as well as the cellular core 112, but that does not degrade the mechanical characteristics of the resulting article 110.

The temperature to which the pre-assembled stack is heated in the method of making the article 110 lies in a range extending from a low temperature enabling the skin layers 114 and 116 to be bonded to the cellular core 112, in a time compatible with mass production constraints, without the cellular core 112 of the stack being weakened accordingly, to a maximum temperature while avoiding degrading the polypropylene too rapidly.

Generally, the quantity of heat transmitted through the skin layers 114 and 116 and the cellular core 112 is inversely proportional to the thickness of the skin layers 114 and 116.

For a given pre-assembled stack temperature and a given pre-assembled stack-heating time, it is possible to bond a skin layer of given thickness. If the skin layer is too thin, it reaches a temperature such that it is degraded. If the skin is too thick, the heat does not arrive in sufficient quantity to enable the skin layers and the core to be bonded together.

For example, in order to bond a skin layer made of a 4×1 woven fabric of weight per unit area of 915 g/m$^2$ to a cellular core, provision is made for the heating time to lie in the range 55 seconds to 75 seconds. By using an identical skin of weight per unit area of 1,420 g/m$^2$, a heating time lying in the range of 70 seconds to 85 seconds is necessary to bond the skin layer to the cellular core without degrading it. Similarly, it has been determined that, for an identical skin layer having a weight per unit area of 710 g/m$^2$, a heating time lying in the range 55 seconds to 65 seconds is necessary to bond it to the cellular core without degrading it.

Referring again to the above-noted application, a compression or cold-pressing mold for making the article 110 is disclosed. The compression mold includes first and second mold halves between which is placed a stack comprising heated blanks of glass-reinforced thermoplastic sheets or layers 114 and 116 which sandwich the core 112 therebetween. The stack of materials are pressed between cool mold surfaces of the first and second mold halves under a pressure lying in the range of 10 to 30 bars (i.e., $1\times10^6$ Pa to $3\times10^6$ Pa).

The method of making the article 110 from the core 112 and the layers 114 and 116 comprise a small number of operations that are simple and quick to perform. They use standard equipment for performing the above-mentioned operations which are controlled very well, and therefore entirely suitable for being implemented at high production throughputs, while also guaranteeing constant quality and economic competitiveness.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A kit from which a plurality of parts are selected and arranged to provide storage areas for at least one of work tools, equipment and supplies in a motor vehicle, the kit comprising:

a plurality of plastic shelves, each of the shelves including:

a reinforced thermoplastic composite panel, each of the panels having: a load-bearing upper skin made of reinforced thermoplastics material; a cellular core of a thermoplastics material; and a bottom skin made of reinforced thermoplastics material wherein each of the skins includes woven fibers or a mat of fibers and a matrix of temperature-degraded polypropylene which wets the fibers to ensure high mechanical performance of the composite panel and wherein the temperature-degraded polypropylene of the skins and the thermoplastics material of the core molecularly bond together to bond the skins to the core, each of the panels having front, back and side edge portions; and a first shelf support of a thermoplastics material and having an outer facing surface and an inner channel dimensioned to receive and retain a first one of the edge portions of the panel, the first edge portion of the panel being bonded to the first shelf support within the inner channel by a molecular bond between the temperature-degraded polypropylene of the skins and the thermoplastics material of the first shelf support; and a pair of side shelf support mechanisms for supporting the shelves in a desired spaced overlapping relationship at the side edge portions of the panels, each of the mechanisms including:

an end panel having an inner surface; and a plurality of hangers for hanging the shelves at selectable desired heights on the inner surface of the end panel in the desired spaced overlapping relationship, each of the hangers receiving and retaining a side edge portion of one of the shelves therein wherein each of the supported shelves is capable of supporting 250 pounds of weight with not more than 8 mm of deflection without a need for additional supports provided in enclosed areas on an undersurface of each of the shelves and wherein each of the shelves is fully recyclable.

2. The kit as claimed in claim 1, wherein the inner channel is U-shaped in cross section.

3. The kit as claimed in claim 1, wherein each of the shelves further includes a second shelf support having an outer facing surface and an inner channel dimensioned to receive and retain a second one of the edge portions of the panel, the second edge portion being bonded to the second shelf support within the inner channel of the second shelf support by a molecular bond between the temperature-degraded polypropylene of the skins and the thermoplastics material of the second shelf support.

4. The kit as claimed in claim 1, wherein each of the shelves is constructed mainly of polyolefin.

5. The kit as claimed in claim 1, wherein the cellular core has a honeycomb-like structure.

6. The kit as claimed in claim 1 further comprising an outer covering layer disposed on the upper skin.

7. The kit as claimed in claim 1, wherein each of the panels is substantially flat and is obtained from a single pressing stage.

8. The kit as claimed in claim 1, wherein the single pressing stage has a forming pressure for forming each of the panels which lies in the range of $10^6$ Pa to $3\times10^6$Pa.

9. The kit as claimed in claim 1, wherein while each of the panels is being formed, the skins have a forming temperature lying in the range of approximately 120° C. to 200° C.

10. The kit as claimed in claim 1, wherein the cellular core has an open cell structure is of the tubular or honeycomb cell type, constituted mainly of polyolefin.

11. A light-weight, plastic shelf comprising:

a reinforced thermoplastic composite panel having: a load-bearing upper skin made of reinforced thermoplastics material; a cellular core of a thermoplastics material;

and a bottom skin made of reinforced thermoplastics material wherein each of the skins includes woven fibers or a mat of fibers and a matrix of temperature-degraded polypropylene which wets the fibers to ensure high mechanical performance of the composite panel and wherein the temperature-degraded polypropylene of the skins and the thermoplastics material of the core molecularly bond together to bond the skins to the core, the panel having front, back and side edge portions; and a first shelf support of a thermoplastics material and having an outer facing surface and an inner channel dimensioned to receive and retain a first one of the edge portions of the panel, the first edge portion of the panel being bonded to the first shelf support within the inner channel by a molecular bond between the temperature-degraded polypropylene of the skins and the thermoplastics material of the first shelf support; and a second shelf support of a thermoplastics material and having an outer facing surface and an inner channel dimensioned to receive and retain a second one of the edge portions of the panel, the second edge portion being bonded to the second shelf support within the inner channel of the second shelf support by a molecular bond between the temperature-degraded polypropylene of the skins and the thermoplastics material of the second shelf support wherein the shelf has a strength-to-weight ratio greater than steel and wherein the shelf is fully recyclable and wherein the supported shelf is capable of supporting 250 pounds of weight with not more than 8 mm of deflection without a need for additional supports provided in enclosed areas on an undersurface of the shelf.

12. The shelf as claimed in claim 11, wherein the inner channel is U-shaped in cross section.

13. A shelving system for providing storage areas for at least one of work tools, equipment and supplies in a motor vehicle, the system comprising:

a plurality of adjustable plastic shelves, each of the shelves including:

a reinforced thermoplastic composite panel, each of the panels having: a load-bearing upper skin made of reinforced thermoplastics material; a cellular core of a thermoplastics material; and a bottom skin made of reinforced thermoplastics material wherein each of the skins includes woven fibers or a mat of fibers and a matrix of temperature-degraded polypropylene which wets the fibers to ensure high mechanical performance of the composite panel and wherein the temperature-degraded polypropylene of the skins and the thermoplastics material of the core molecularly bond together to bond the skins to the core, each of the panels having front, back and side edge portions; and a first shelf support of a thermoplastics material having an outer facing surface and an inner channel dimensioned to receive and retain a first one of the edge portions of the panel, the first edge portion of the panel being bonded to the first shelf support within the inner channel by a molecular bond between the temperature-degraded polypropylene of the skins and the thermoplastics material of the first shelf support; and a pair of side shelf support mechanisms for supporting the shelves in a desired spaced overlapping relationship at the side edge portions of the panels, each of the mechanisms including:

an end panel having an inner surface; and a plurality of hangers for hanging the shelves at selectable desired heights on the inner surface of the end panel in the desired spaced overlapping relationship, each of the hangers receiving and retaining a side edge portion of one of the shelves therein wherein each of the supported shelves is capable of supporting 250 pounds of weight with not more than 8 mm of deflection without a need for additional supports provided in enclosed areas on an undersurface of each of the shelves and wherein each of the shelves is fully recyclable.

14. The system as claimed in claim 13, wherein the inner channel is U-shaped in cross section.

15. The system as claimed in claim 13, wherein each of the shelves further includes a second shelf support of a thermoplastics material having an outer facing surface and an inner channel dimensioned to receive and retain a second one of the edge portions of the panel, the second edge portion being bonded to the second shelf support within the inner channel of the second shelf support by a molecular bond between the temperature-degraded polypropylene of the skins and the thermoplastics material of the second shelf support.

* * * * *